US005459545A

United States Patent [19]

Tsubaki et al.

[11] Patent Number: 5,459,545

[45] Date of Patent: Oct. 17, 1995

[54] PHOTOSENSITIVE MATERIAL PROCESSING METHOD AND APPARATUS THEREOF

[75] Inventors: Yoshifumi Tsubaki; Kunio Kanai; Hiromi Yanatori, all of Hino, Japan

[73] Assignee: Konica Corporation, Japan

[21] Appl. No.: 116,450

[22] Filed: Sep. 3, 1993

[30] Foreign Application Priority Data

| | | | |
|---|---|---|---|
| Sep. 8, 1992 | [JP] | Japan | 4-239727 |
| Sep. 10, 1992 | [JP] | Japan | 4-242024 |

[51] Int. Cl.[6] ..... G03D 3/02

[52] U.S. Cl. ..... 354/324; 430/465; 430/450; 430/398; 354/298

[58] Field of Search ..... 354/324, 328, 354/298; 430/450, 465, 458, 399, 400, 398

[56] References Cited

U.S. PATENT DOCUMENTS

| | | | |
|---|---|---|---|
| 5,240,822 | 8/1993 | Tanaka et al. | 430/450 |
| 5,316,898 | 5/1994 | Ueda et al. | 430/400 |
| 5,318,061 | 6/1994 | Saito | 354/324 X R |
| 5,334,492 | 8/1994 | Wernicke et al. | 430/398 |
| 5,402,196 | 3/1995 | Ishida et al. | 354/324 |

FOREIGN PATENT DOCUMENTS

| | | | |
|---|---|---|---|
| 524414 | 1/1993 | European Pat. Off. | G03C 7/44 |
| 537365 | 4/1993 | European Pat. Off. | G03D 3/06 |
| 92-20013 | 11/1992 | WIPO | 354/324 |

*Primary Examiner*—D. Rutledge

*Attorney, Agent, or Firm*—Jordan B. Bierman; Bierman and Muserlian

[57] ABSTRACT

In a method of processing a photosensitive material in a processing solution, a solid component and water are fed separately. A working solution is prepared by dissolving the solid component in the water. Thereafter; the photosensitive material is processed by being brought in contact with the working solution.

19 Claims, 9 Drawing Sheets

PHOTOSENSITIVE MATERIAL PROCESSING METHOD AND APPARATUS THEREOF

BACKGROUND OF THE INVENTION

The present invention relates to a photosensitive material processing method and apparatus thereof in which a processing agent is not supplied in the form of a working solution or a concentrated solution but it is supplied in the form of solids and water.

Development processing of silver halide photosensitive material has a long history, and its essential technology has already been established. However, the handling operation of the processing agent leaves room for improvement.

Especially, in laboratories in which automatic developing apparatus are used so as to process a large amount of silver halide photosensitive material periodically or nonperiodically, a large amount of processing solution is consumed. Therefore, it is necessary to provide a large space for stocking the processing solution to be used. Further, it is also necessary for stocking the waste solution. The above disadvantages have become conspicuous in these days.

Concerning the waste solution, technology to concentrate it has been developed recently, so that the space to stock the waste solution is to be reduced. However, concerning a space to stock a new processing solution, an effective method to reduce the space has not been found yet.

Conventionally, the following method has not been employed: a processing agent is supplied in the form of powder or concentrated solution; and the supplied powder or the concentrated solution is stirred by a mixer so that it can be dissolved in water. In this case, the following disadvantages may be encountered. The dissolving speed of powder is not stable and further powder tends to scatter, so that it is necessary to use mixer for dissolving powder in water. Therefore, a space must be provided for installing the mixer, and further the cost is increased for the mixer. For that reason, the processing solution has been supplied in the form of a completely dissolved working solution. However, the preserving properties of the working solution are not good, and while the working solution is stocked, it is deteriorated by oxidization. Moreover, a large space must be provided to stock the working solution. Accordingly, a processing solution supply method by which the deterioration of a solution can be prevented and the stocking space can be reduced has been desired.

In order to overcome the disadvantages described above, consideration is given to tablets containing the processing agent. That is, supplying tablets formed by removing water from the processing agent makes this system free from deterioration while it is stocked, and further makes the stocking space reduce.

However, development efforts have been concentrated on the supplying of tablets in place of replenishing the processing agent to a mother processing solution, in order to make up for the deterioration. Therefore, only the development of technology in which the tablets are quickly dissolved in the mother processing solution has been tryed, and the entire system to supply all the processing agents in the form of tablets has not been developed yet.

Technology to control the supply of processing agents, dissolution and stirring necessary for stabilizing the processing of photosensitive materials has not been established yet in the case where the processing agents are supplied not only in the form of tablets but also in the form of solids. Actually, for this reason, processing agents have not been used in the form of tablets or solids.

In view of the disadvantages of conventional technology, the first object of the present invention is to provide a photosensitive processing method and an apparatus thereof by which photosensitive materials can be stably processed when the processing agent is supplied in the form of solids such as tablets.

The second problem to be solved by the present invention is related to improvements in photosensitive material processing technique for stabilizing development processing of silver halide photosensitive material over a long period of time, using the solid processing agent described above.

There is provided an automatic developing machine for continuously conducting development processing of photosensitive material. In the automatic developing machine, it is common to stabilize the processing capacity by replenishing a processing agent and adding an addition agent. However, all the factors relating to the processing capacity have not been made clear yet. Therefore, an amount of photosensitive material processed up to this time is employed to be a factor relating to the processing capacity of an automatic developing machine, and the processing capacity has been maintained at a predetermined level when new processing agent is replenished and old processing agent is discharged by overflowing in accordance with the amount of photosensitive material processed by the developing machine. In order to make up for the deterioration caused by the lapse of time, the additional agent is required to the added.

Concerning the replenishment of the processing agent, a volume of the processing agent is large in the condition of a working solution. Therefore, a large space is required for stocking the processing agent in the form of a working solution. Further, the processing capacity of the agent is deteriorated while it is stocked. It is required to overcome the above disadvantages. In the case where the processing agent is replenished in the form of powder or a concentrated solution, it is essentially required to uniformly dissolve it before supplying. Therefore, powder or a concentrated solution is dissolved in a different apparatus and then supplied to the developing machine. Alternatively, it becomes neccessary to use a mixer to automatically dissolve the powder of concentrated solution, which costs much labor, and the structure of the apparatus becomes complicated.

Even when a preparatory dissolving tank for previous dissolution is provided, it takes time for the processing agent to be replenished, because it must be heated and stirred. Therefore, the preparatory dissolving tank can not meet the requirement of urgent necessity.

In view of the above disadvantages of technology of the prior art, the second object of the present invention is to provide a photosensitive material processing method and apparatus thereof characterized in that: when a processing agent is charged in the form of solids processing agent component and water, the stocking space can be reduced and the deterioration of the processing agent can be prevented while it is stocked; and the processing agent can be dissolved and mixed without increasing costs and requiring much labor; and the dissolving speed of the solid processing agent component is controlled so that the processing can be stabilized.

SUMMARY OF THE INVENTION

The first object can be accomplished by a photosensitive material processing method for visualizing a latent image formed in silver halide photosensitive material by contacting a developing agent with the silver halide photosensitive material, including the steps of: charging the components of the developing agent that have been divided into a solid component and water so as to provide a working solution in which the solid component is dissolved in the water; and contacting the working solution with the photosensitive material.

The aforementioned object can be accomplished by a photosensitive material processing apparatus for visualizing a latent image formed in silver halide photosensitive material by contacting a developing agent with the silver halide photosensitive material, including: a means for charging the developing agent that has been divided into a solid component and water; and a stirring means activated between the supplied solid component and the photosensitive material.

Further, the aforementioned object can be accomplished by a photosensitive material processing method including the steps of: charging water and a solid component to a mother solution of a processing apparatus having a processing tank; dissolving and stirring the water and the component so as to start processing; and water and a solid component are controlled so as to be replenished in accordance with a processing amount and lapse of time.

The reason why the development processing agent is supplied in the form of solids and water in the present invention is described as follows. When the processing agent is supplied in the form of solids and a necessary amount of water is supplied from the city water supply system, the volume and weight of the processing agent can be reduced in the supply process, so that the costs of transportation and storage can be reduced, and the deterioration of the processing agent can be prevented while it is stocked.

The solid component of the development processing agent is uniformly dissolved so that the most appropriate concentration can be provided. Therefore, the apparatus is constructed so that a predetermined amount of water corresponding to the amount of the solid component can be added and an amount of water to be supplied can be controlled in accordance with the dissolution speed of the solid component.

Water is supplied to a portion where the solid component is supplied, or a portion close to it. In other words, the portion where the solid component is supplied is not specified, however, water is supplied to a portion in which the solid component is supplied or to a portion close to it wherever it is. The reason is that the supplied water can directly act on the charged solid component. According to the prior art, consideration has not been given to the aforementioned point. Therefore, dissolution of the processing agent supplied in the form of solids can not be appropriately controlled, and the processing can not be stabilized.

According to the present invention, water is supplied before the solid component is supplied. The reason is described as follows. When water for dissolution exists beforehand, the solid component can be stably dissolved. This method is effective not only when the mother processing solution is initially made, but also when the solid component is replenished. In the case of replenishment, when water is supplied first and then the solid component is added, the mother processing solution is partially diluted with the added water, and then the solid component is supplied into the water. Therefore, the supplied component first comes into contact with the supplied water or the diluted processing solution. Accordingly, the deteriorated processing solution is not contacted with the supplied solid component, so that the deteriorated processing solution is not absorbed by the supplied solid component. Due to the aforementioned advantages, the solid component can be stably dissolved in water.

According to the present invention, a stirring means is activated between the supplied solid component and the photosensitive material. The reason is described as follows. When a solid component such as tablets is dissolved in water, it takes time for the solid component to be uniformly dissolve in water, so that unevenness tends to occur in the photosensitive material when it is in a region where the solid component is being dissolved. For this reason, the stirring means is activated between the supplied solid component and the photosensitive material in order to prevent the occurrence of a sharp change.

According to the present invention, a partition member through which the processing solution can pass is provided between the supplied solid component and the photosensitive material. The reason is described as follows. The supplied solid component is prevented from moving and directly coming into contact with the photosensitive material, and also a distance between the supplied solid component and the photosensitive material is prevented from being reduced to a value smaller than a predetermined one. A net-shaped or porous partition member may be used so that the processing solution can pass through it, however, a plate-shaped partition member having no holes may be used, wherein the processing solution passes around them.

According to the present invention, the mother processing solution of the processing apparatus having the processing tank is made when water and a solid component are supplied. The reason is described as follows. From the viewpoint of controlling the entire system, it is not desirable to supply the mother processing solution through a different supply route. Accordingly, the mother processing solution is made when the water and solid component supply system is effectively utilized. In order to stably conduct the processing, a dissolving and stirring operation is carried out, and then the processing is started. Since the processing solution is deteriorated as the processing advances and also the processing solution is deteriorated with the lapse of time, water and the solid component are added.

A method to control an amount of replenishing solution in accordance with the lapse of time has already been developed and disclosed. However, the circumstances are quite different in the case where a solid component is supplied according to the present invention. Since processing can not be stably continued when the replenishing solution is supplied according to the conventional method, consideration is given to a factor of dissolving speed in the present invention, and the replenishing operation of water and solid component is controlled in accordance with the amount of processing and the lapse of time.

In order to accomplish the second object, the present invention is to provide a photosensitive material processing method for visualizing a latent image formed on silver halide photosensitive material by contacting a developing agent with the silver halide photosensitive material, including the steps of: charging the components of the developing agent that have been divided into a solid processing agent component and water; and controlling the dissolving speed of the solid processing agent component so as to stabilize the processing.

The present invention is also to provide a photosensitive material processing apparatus comprising: spaces to accommodate a solid processing agent component and water of a development agent, the concentration of which is appropriate for developing photosensitive material; a dissolving speed changing means that acts on the solid processing agent component; and a control means to control the dissolving speed changing means.

The present invention is also to provide a photosensitive material processing apparatus comprising: an accommodation unit to accommodate a solid processing agent component and water, the solid processing agent component being capable of composing a development agent of the appropriate concentration when it is dissolved in water by a predetermined ratio; a photosensitive material processing unit communicated with the accommodation unit; a detection means to detect the degree of deterioration of the development processing agent in the photosensitive material processing unit; a dissolving means to change the dissolving speed by acting on the solid processing agent component; and a control means to control the dissolving means in accordance with the information provided by the detection means.

In the present invention, the solid processing agent is defined as follows: the solid processing agent is formed into a solid body tightly solidified, or a solid body including spaces in which air is contained; and the size of each solid body is not specified, however, the solid processing agent is formed into a body of a predetermined size.

The manufacturing method of the solid processing agent of the present invention is not specified, that is, a liquid processing agent may be dried and solidified, or processing agent components may be mixed and solidified.

When the aforementioned solid processing agent is mixed with water by a predetermined ratio, a development processing agent of an appropriate concentration can be provided. In this case, a foaming type processing agent is not included which suddenly foams when it is mixed with water.

In this invention, the receiving unit is a space in which the solid processing agent is dissolved, and the receiving unit is not necessarily an independent space, but a space communicated with the photosensitive material processing unit so that the processing solution can enter the space.

In this invention, the dissolution means positively acts upon the solid processing agent charged into the receiving unit so as to dissolve the solid processing agent in water, wherein the operational speed of the dissolution means can be varied. Therefore, the temperature and the rate of stirring, which are factors participating in dissolution, can be varied.

In this invention, the control means is operated in the following manner. According to the information sent from the development processing agent deterioration detection means provided in the photosensitive material processing unit, the control means controls the dissolution means so as to control the dissolution means of the solid processing agent. In this way, the processing solution can be replenished to make up for the deterioration of the development processing agent, and the processing performance can be stably maintained.

When the temperature is high, the dissolving speed is high, and when the temperature is low, the dissolving speed is low. The stirring means positively acting upon the solid processing agent may be a means, for example, to rub with brushes, to blow liquid, or to oscillate the solid processing agent. When the operational speed of the stirring means is varied, the moving speed of the solution around the solid processing agent is changed, so that the dissolving speed can be varied.

In this invention, from an indirect viewpoint, the factors to detect the degree of deterioration of the development processing agent are an amount of processed photosensitive materials, and a period of time that has lapsed. Also, from a direct viewpoint, the factors to detect the degree of deterioration of the development processing agent is a degree of deterioration measured by means of optical transmission measurement or pH measurement.

DETAILED DESCRIPTION OF THE PREFERRED EMBODIMENT

With reference to the attached drawings, a specific example of the present invention will be explained as follows.

Figure 1:
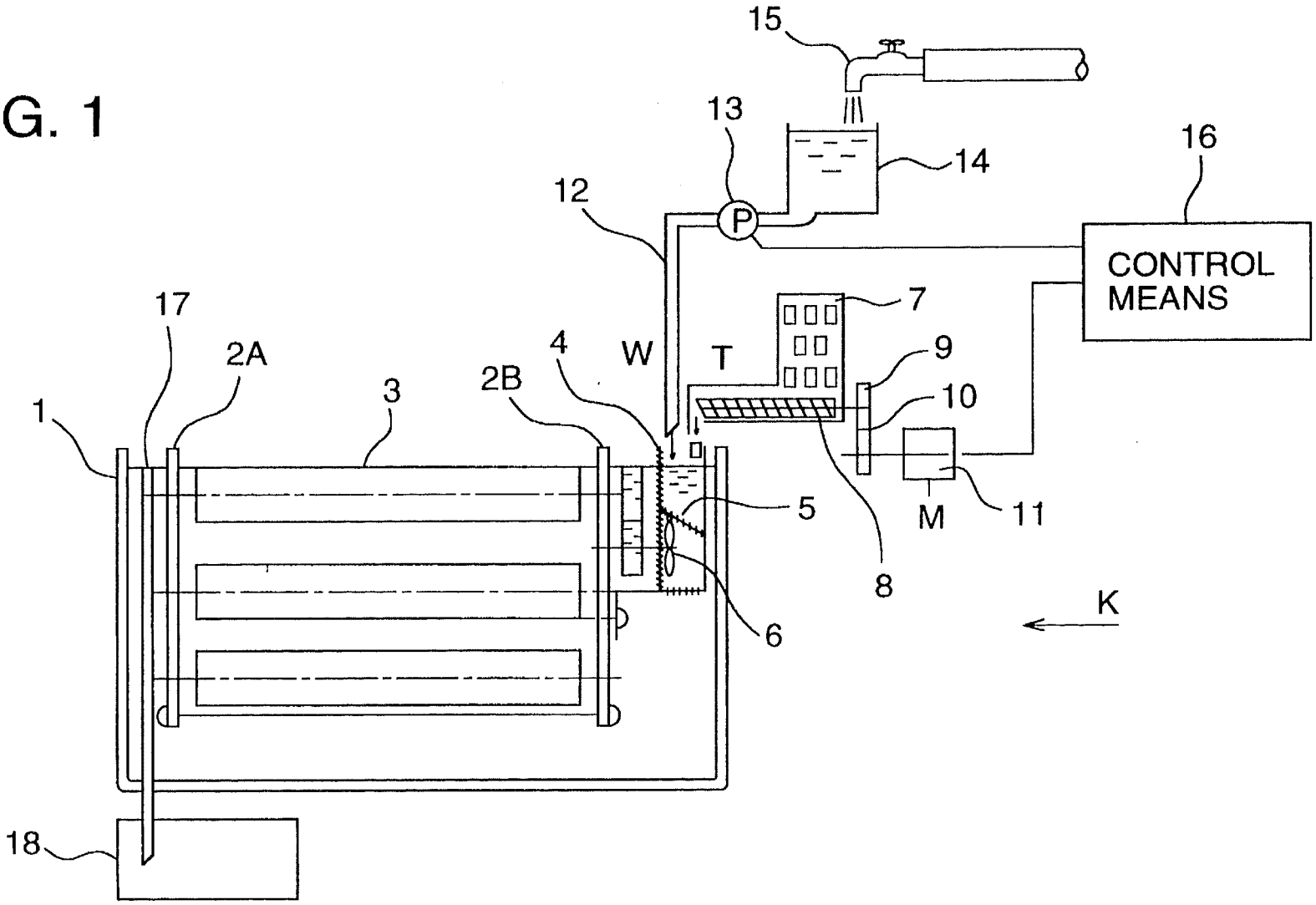
FIG. 1 is a sectional view of a photosensitive material processing apparatus of an example of the present invention.

FIG. 1 is a sectional view showing an overall arrangement of the photosensitive material processing apparatus of an example of the present invention. In FIG. 1, the section of a processing tank 1 is shown, wherein the view is taken from the upstream side of the flow of the photosensitive material. A charging means 8 to charge a solid component T of the processing agent, and a pipe 12 to charge water W to be used as dissolving water are provided in the upper portion of a processing agent charging unit 4.

The processing agent charging unit 4 is provided in a space formed between a side wall of the processing tank 1 and a side plate 2B of a rack used for the conveyance of photosensitive material, so that the solid component can not directly enter a photosensitive material conveying passage. A rotary blade 6, which is a stirring means, is provided in a space separated by a partition member 5 such as a net or a plate having holes through which the processing solution can pass. By the action of the rotary blade 6, the dissolution of the solid component is facilitated, and further the dissolved processing solution is uniformly dispersed in the processing tank 1.

The rotary blade 6 is driven by a gear unit provided at the end of a conveyance roller 3 for the conveyance rack. It is to be understood that the stirring means is not limited to the rotary blade 6 shown in the drawing of the present invention, and that the drive means of the rotary blade 6 is not limited to a gear unit provided at the end of the conveyance roller, either.

For example, the rotary blade 6 may be driven by a motor, the rotational speed of which can be controlled by a control means. In this case, the dissolving speed of the solid component T can be adjusted. Therefore, this means is more effective.

Figure 2:
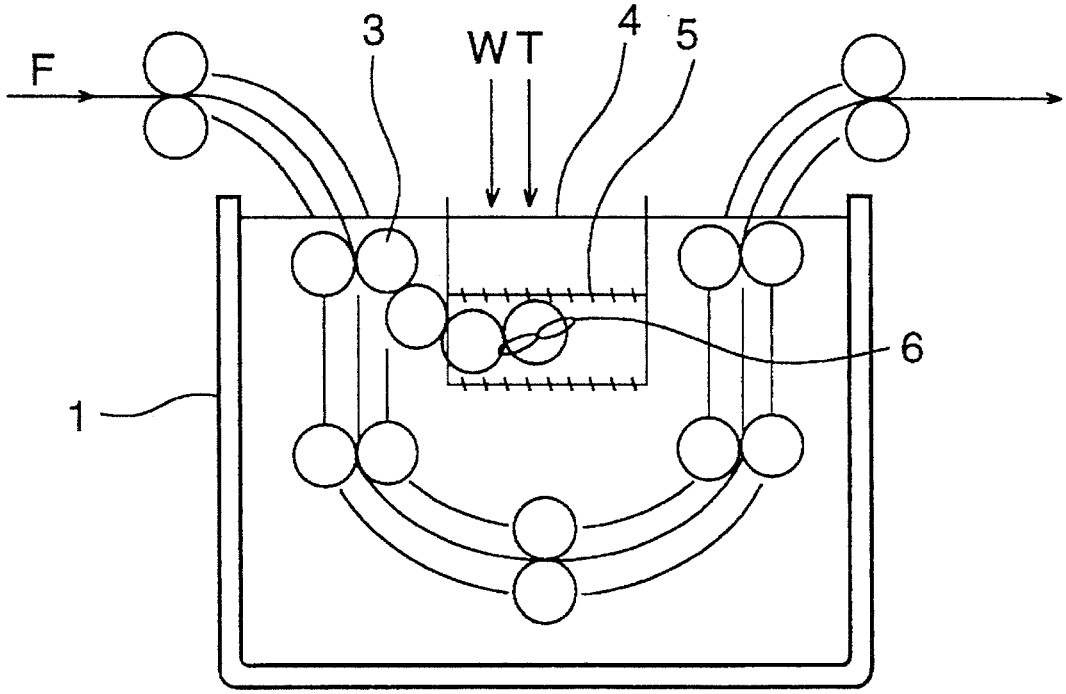
FIG. 2 is a sectional view of the above apparatus.

FIG. 2 is a sectional view of the processing tank 1 including a processing agent charging unit 4 and the rotary blade 6, wherein the view is taken from a direction shown by arrow K in FIG. 1.

Photosensitive material F is developed with a processing agent while it passes through a conveyance passage formed by the conveyance roller 3 as shown in FIG. 2. The processing agent charged in the processing tank 1 is deteriorated when the photosensitive material F is processed in the tank 1, that is, components of the processing agent are consumed and the reaction products are accumulated in the processing agent, and further the processing agent is deteriorated with the age. For this reason, it is necessary to replenish the processing agent so as to continue the stable development operation.

In this example, the processing agent is replenished in the form of solid component T and water, and the solid component is dissolved so that the processing agent can be provided to develop the photosensitive material. The solid components T accommodated in the accommodation unit 7 are conveyed to an opening and charged into the tank 1 by the charging means 8.

In the example shown in FIG. 1, the charging means 8 is composed of a lead shaft having a spiral groove into which solid component T is charged, wherein the lead shaft is driven by the motor 11 so that the solid component in the spiral groove can be conveyed. When the rotation of the motor 11 is controlled by the controlling means 16, the charging operation to charge the solid component can be controlled.

City water 15 is stocked in a stock unit 14, and sent through a pipe 12 by a pump 13 connected with a control means 16. Then, water is poured to a portion close to an opening through which the solid component T is charged. Water is poured to the opening before the solid component is charged. Therefore, the used processing solution charged to a predetermined level of the tank is diluted with the charged water. Successively, the solid component is charged into the water. Accordingly, the charged solid component is smoothly dissolved. When the processing agent is added in the manner described above, the solution level is raised. However, the raised level is lowered to a predetermined level when the processing solution overflows from an overflow port 17 to a waste solution tank 18. It is preferable that the waste solution overflows from the overflow port 17. Therefore, the overflow port 17 is located in the most distant position from the charging unit 4.

Figure 3:
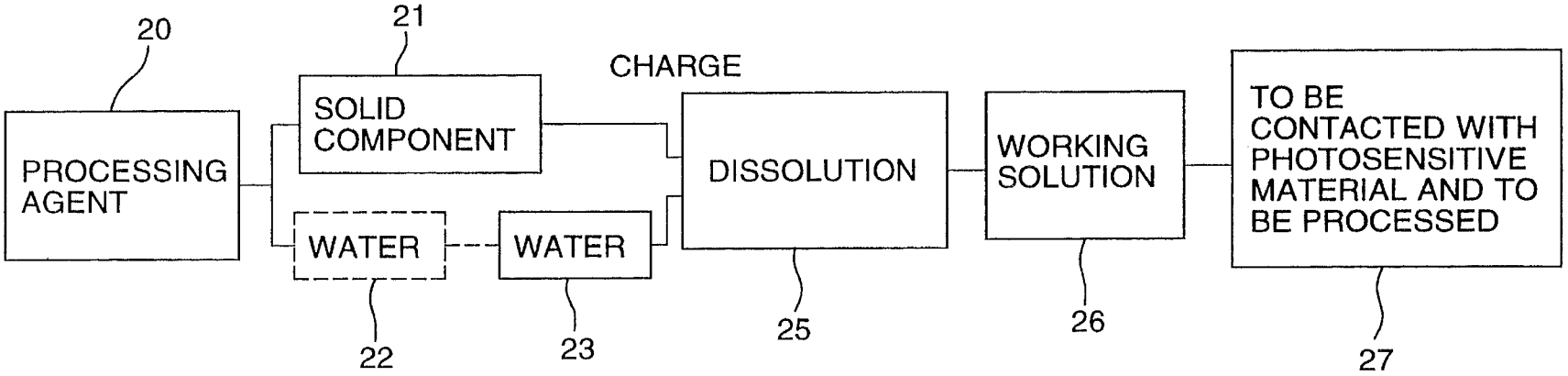
FIG. 3 is a block diagram of an exemplary photosensitive material processing method of the present invention.

With reference to FIG. 3, the essential construction of the processing method of the present invention will be explained as follows.

A processing agent 20 is properly prepared to develop the photosensitive material. Then, the processing agent 20 is already prepared as intentionally divided into a solid component 21 and water 22. The solid component 21 and water 22 are seperately and almost concurrently charged into the tank. The solid component 21 is dissolved 25 in water so as to become a working solution 26. The working solution 26 comes into contact 27 with the photosensitive material for development. In the process described above, various method can be applied to manufacture the solid component 21. It is not necessarily limited to the aforementioned method in which the processing solution is divided into the solid component and water, but the solid component may be independently formed when necessary components are combined. The solid component may be formed into a solid body, grains or powder. Alternatively, the solid component may be formed into a connected solid body including gaps in which air is contained. Preferably, the solid component may be formed into tablets because the handling properties are excellent. In the process shown in the drawing, the water separated from the processing solution is used, however, city water may be used for dissolving the solid component to compose the processing agent. Concerning the place where the solid component and water are charged and dissolved, the processing tank 1 may be provided as shown in FIG. 1 in the case of a processing apparatus having a processing tank, or a dissolution tank may be separately provided. In the case of a processing apparatus having no processing tank, for example, in the case of a processing apparatus of coating or shower type, a container to supply the processing solution to the coating or shower means may be provided.

Figure 4:
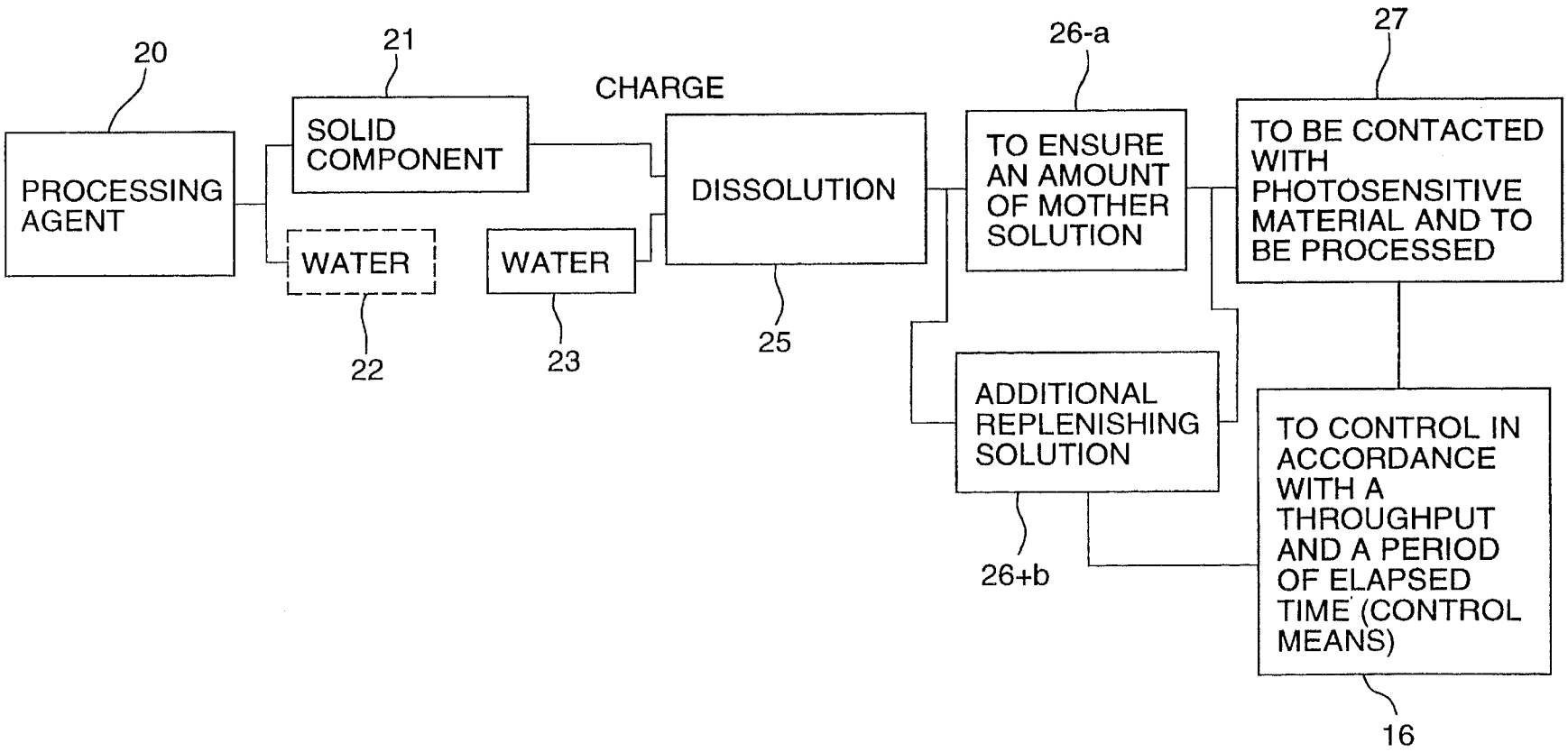
FIG. 4 is a block diagram of a photosensitive material processing method of another example of the present invention.

With reference to FIG. 4, the second example of the processing method of the present invention will be explained as follows.

In the same manner as that explained with reference to FIG. 3, a solid component and water are charged and dissolved in the processing tank. The mother processing solution is charged to a predetermined level of the processing tank. After the processing has been started, the processing solution is replenished by the direction of the control means 16 in accordance with the processing amount and the lapse of time.

In the aforementioned case, the change of the processing agent caused when the processing amount increases and the time lapses, is previously investigated and stored in the control means. In accordance with the stored data, a control operation is carried out to make up for the change of the processing solution. Since the processing agent is replenished in the form of a solid component and water, deterioration of the processing agent can be prevented. When the solid component is stocked, reaction water does not coexist with the solid component, so that the reaction to deteriorate the solid component does not advance. For this reason, it is necessary to keep the solid component away from moisture. Therefore, the solid component must be subjected to moisture-proof treatment, or moisture-proof packing.

As described above, the dissolution of the solid component is controlled in a small space, and the processing agent is separated and stirred so that the photosensitive material can not come into contact with a portion of the processing agent, the concentration of which is high. In this way, the processing agent is uniformly dispersed. Therefore, the processing is not changed suddenly, and it is possible to ensure the stabilization of processing.

As the apparatus of the present invention is constructed in the manner described above, the solid component of processing agent can be preserved in a good condition, and the stock space can be reduced. Accordingly, the handling property of the processing agent can be greatly improved, and the stability of processing can be ensured.

Next, a specific example to accomplish the second object will be described as follows.

The development processing agent capacity is lowered by various factors. Therefore, it is difficult to make up for the lowered capacity by simply adding a predetermined amount of new processing agent. Accordingly, in the present invention, a plurality of models are previously set. Then, various examples of processing capacity deterioration are stored, and also the deterioration speed of each example is measured and stored in a memory in the form of a master table. Further, the processing solution supplementary speed determined by the dissolution speed of the solid processing agent is stored in the memory with respect to the rate of stirring at the processing agent charge unit, the dissolution temperature and the relative concentration.

The master table is made in the following manner: The characteristics of the development processing agent are checked at predetermined time (t) intervals. The deterioration speed $\Delta D/t$ of the deterioration amount $\Delta D$ is calculated. The deterioration supplement changing speed $\Delta S/t$ of the supplement amount $\Delta S$ accompanying by the dissolution of the solid processing agent, is previously set with respect to the combination of the stirring speed and the temperature.

Figure 5:
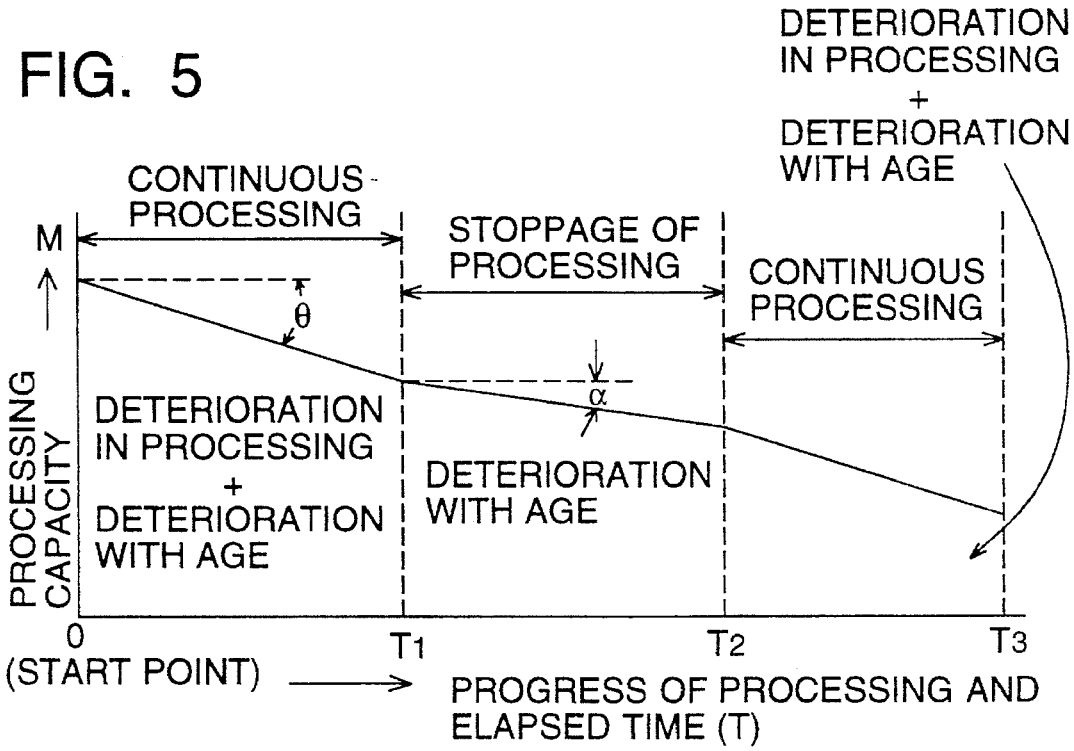
FIG. 5 is a characteristic diagram showing the lowered processing capacity of a mother solution.

In general, in a processing system in which the development processing agent is stocked as a mother solution in the photosensitive material processing unit, the deterioration of the development processing agent can be expressed by the deterioration of the processing capacity of the mother solution as shown in FIG. 5. When the vertical axis represents the processing capacity M and the horizontal axis represents the progress of the processing and the elapsed time, the deterioration can be expressed by a downward straight line, the inclination angle of which is $\theta$ in the case where the processing is continuously carried out for a period of time $T_1$. Next, when the processing is stopped for a period of time $T_2$, the deterioration can be expressed by a downward straight line, the inclination angle of which is $\alpha$.

In the case where the aforementioned deterioration is recovered by replenishing a supplementary solution, the effect of supplement depends on an amount of the mother solution. In order to simplify the explanation, the influence of supplement will be explained here in the case of a model in which the amount of mother solution is constant. In the case where the amount of the mother solution is different, an appropriate value can be provided when a factor is multiplied.

Figure 6:
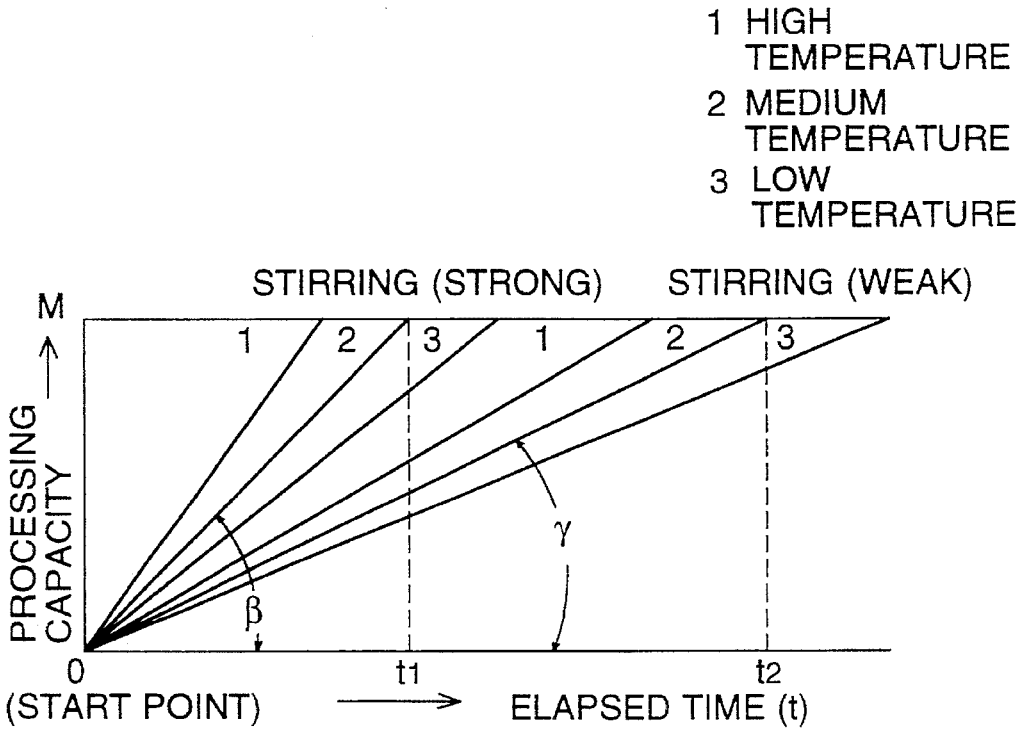
FIG. 6 is a characteristic diagram showing the dissolution speed of a solid processing agent.

The processing capacity of a piece of solid processing agent is defined as M in the case of the piece of solid processing agent is completely dissolved under the condition that the amount of mother solution is specified. Then, the inclination of the supplement can be expressed as shown in FIG. 6.

The vertical axis represents the processing capacity, and the horizontal axis represents the elapsed time. In the case where the solution is strongly stirred, the solid processing agent is completely dissolved in a period of time $t_1$, so that the processing capacity reaches the supplementary capacity M, and its inclination angle is $\beta$. When the temperature is raised, the processing capacity reaches M in a period of time shorter than $t_1$. Accordingly, the inclination angle becomes larger than $\beta$. When the temperature is lowered, the processing capacity reaches M in a period of time longer than $t_1$. Accordingly, the inclination angle becomes smaller than $\beta$.

In the case where the stirring operation is weakly conducted, the entire solid processing agent is dissolved in a period of time $t_2$, and the processing capacity reaches the supplementary capacity M. Its inclination angle is $\gamma$. When the temperature is raised, the processing capacity reaches M in a period of time shorter than $t_2$. Accordingly, the inclination angle becomes larger than $\gamma$. When the temperature is lowered, the processing capacity reaches M in a period of time longer than $t_2$. Accordingly, the inclination angle becomes smaller than $\gamma$.

As described above, when the processing capacity of the development processing agent is lowered, it is expressed by a downward inclination line, and when the solid processing agent is dissolved and the processing capacity is increased, its supplementary capacity is expressed by an upward inclination line. Then, a plurality of models are set as described above, and the decrease in the processing capacity and the increase in the processing capacity according to the dissolution of the solid processing agent are stored in the master table. The decrease in the processing capacity of the development processing agent is detected by the detection means (not shown), and the dissolution speed of the solid processing agent is selected by the control means and the dissolution means is controlled in accordance the selected dissolution speed.

With reference to FIGS. 5 and 6, a specific example will be explained as follows. At the start point, the processing capacity of the mother solution is 100%. The supplementary inclination is chosen from FIG. 6 so that it coincides with a downward inclination $-\theta$ shown in FIG. 5, and the stirring operation and the temperature are controlled in accordance with the inclination. As a result of the foregoing control operation, the decrease in the processing capacity of the mother solution can be prevented until one piece of the solid processing agent is completely dissolved. In this way, the processing capacity can be stably maintained.

The time interval to detect the degree of deterioration of the development processing agent is appropriately set within a range of time in which the solid processing agent is completely dissolved.

In order to control the dissolution speed of the solid processing agent, a foaming type solid processing agent is not applied to the present invention, whereas the foaming type solid processing agent is suddenly foamed and dissolved when it comes into contact with water.

Since the dissolution speed is different in each processing agent, the dissolution speed is not specified, however, it is preferable that the dissolution speed is low, or the processing agent is difficult to be dissolved. It is also preferable that the dissolution speed can be increased when the dissolution means acts on the processing agent. Essentially, the deterioration speed of the development processing agent is gentle. Therefore, it is preferable that the dissolution to make up for the deterioration is gently conducted. In order to reduce the dissolution speed, the charged solid processing agent may be surrounded so as to stop the communication or the charged solid processing agent may be cooled. Alternatively, a cooler may be assembled to the temperature control device.

Figure 7:
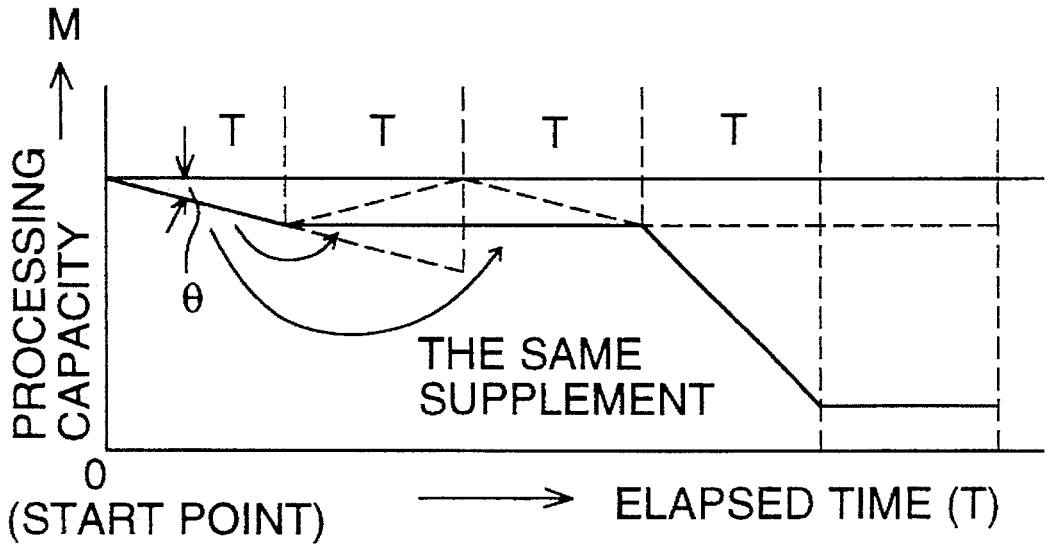
FIG. 7 is a characteristic diagram showing a model of the deterioration of a mother solution and the supplement of a processing agent in supplementary dissolution.
Figure 8:
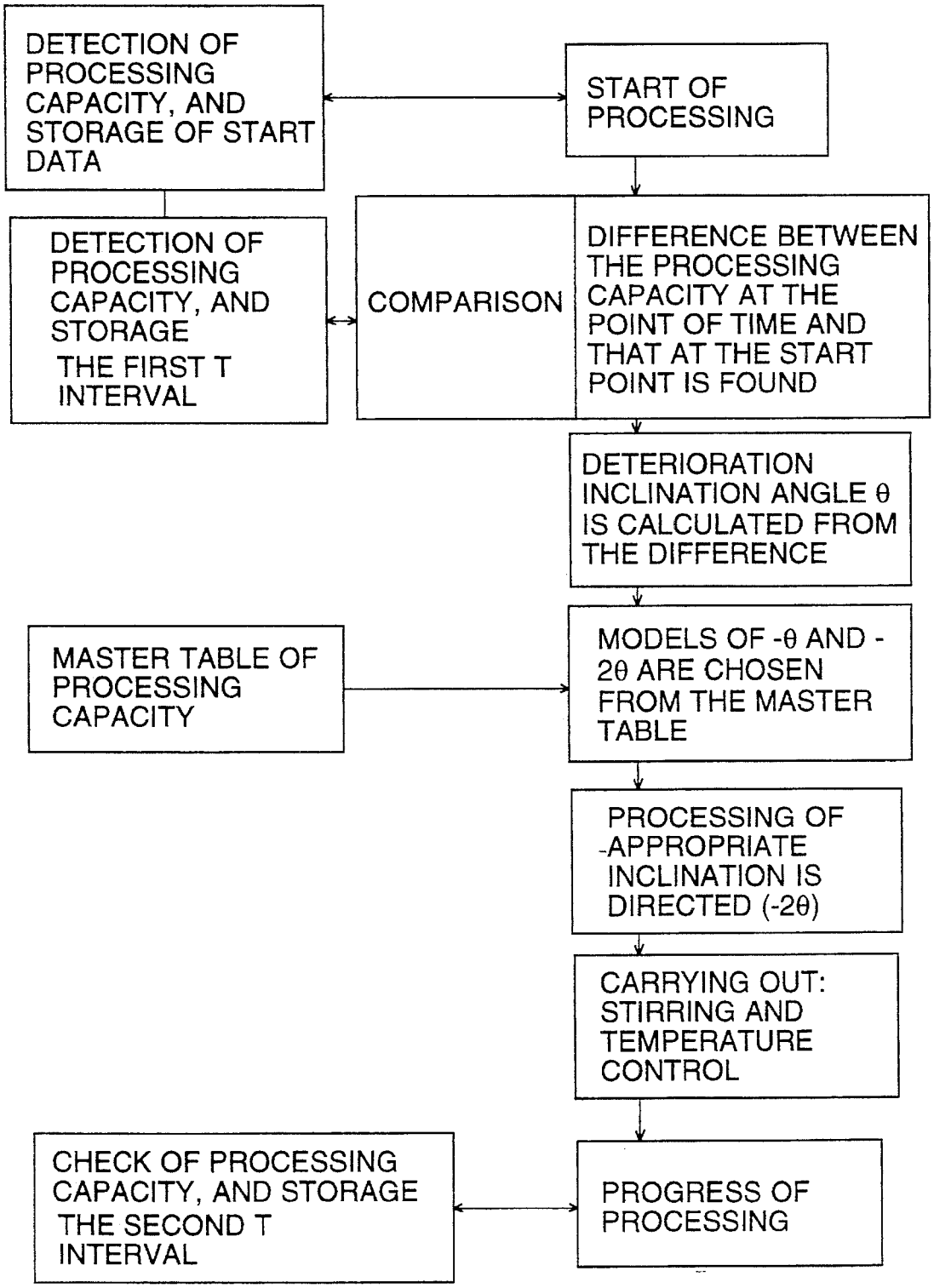
FIG. 8 is a flow chart of an example.

Next, with reference to a characteristic diagram shown in FIG. 7 and a flow chart shown in FIG. 8, an operational sequence of the model will be explained as follows.

A detecting operation is conducted to detect the processing capacity after a predetermined period of time T has passed. First, after the predetermined first period of time T has passed, the processing capacity and the difference are found, and the deterioration inclination $\theta$ is found. The dissolution data, the dissolution inclination of which corresponds to the deterioration inclination of $-\theta$ and $-2\theta$, is chosen from the master table. Then, the dissolution data of $-2\theta$ is applied, and successively the dissolution is conducted until the second period of time T has passed. After the second period of time T has passed, a detecting operation is conducted.

The reason why the dissolution inclination of $-2\theta$ is applied here is as follows:

The deterioration is made up after the first T, and the processing capacity is returned to a value at the start point. This operation is conducted on the assumption that the deterioration, the inclination of which is the same as that in the first T, is conducted in the second period of time T.

However, the inclination in the second period of time T is not necessarily the same. For example, when the processing is performed in this period of time, the deterioration of a sharper inclination may occur. Accordingly, the processing capacity after the second T is not necessarily returned to the value of the start point. Therefore, the processing capacity at the point of time is detected, and the inclination $-2\theta$ to return to the value of the start point in the next T is calculated. When the calculated data is compared with the data in the master table, the dissolution inclination equal to $-2\theta$ is chosen and applied. In the case where the inclination is the same in the second T, the processing capacity is returned to the value of the start point by the dissolution of $-2\theta$. Accordingly, when it is judged that the processing capacity of the point of time is the same as that of the start point, the next supplementary operation is conducted by the dissolution inclination of $-\theta$. Due to the foregoing, the dissolution of $-\theta$ corresponding to the anticipated deterioration of inclination $\theta$ is conducted, so that the processing capacity in the third T can be maintained at the same value as that of the start point.

In this connection, the charge of the solid processing agent is controlled in the following manner: An amount of solid processing agent to be charged can be detected by the difference between the detection data of the processing capacity and the data obtained by a simulation of the dissolution inclination control. According to the data, the charging operation is carried out.

Figure 9:
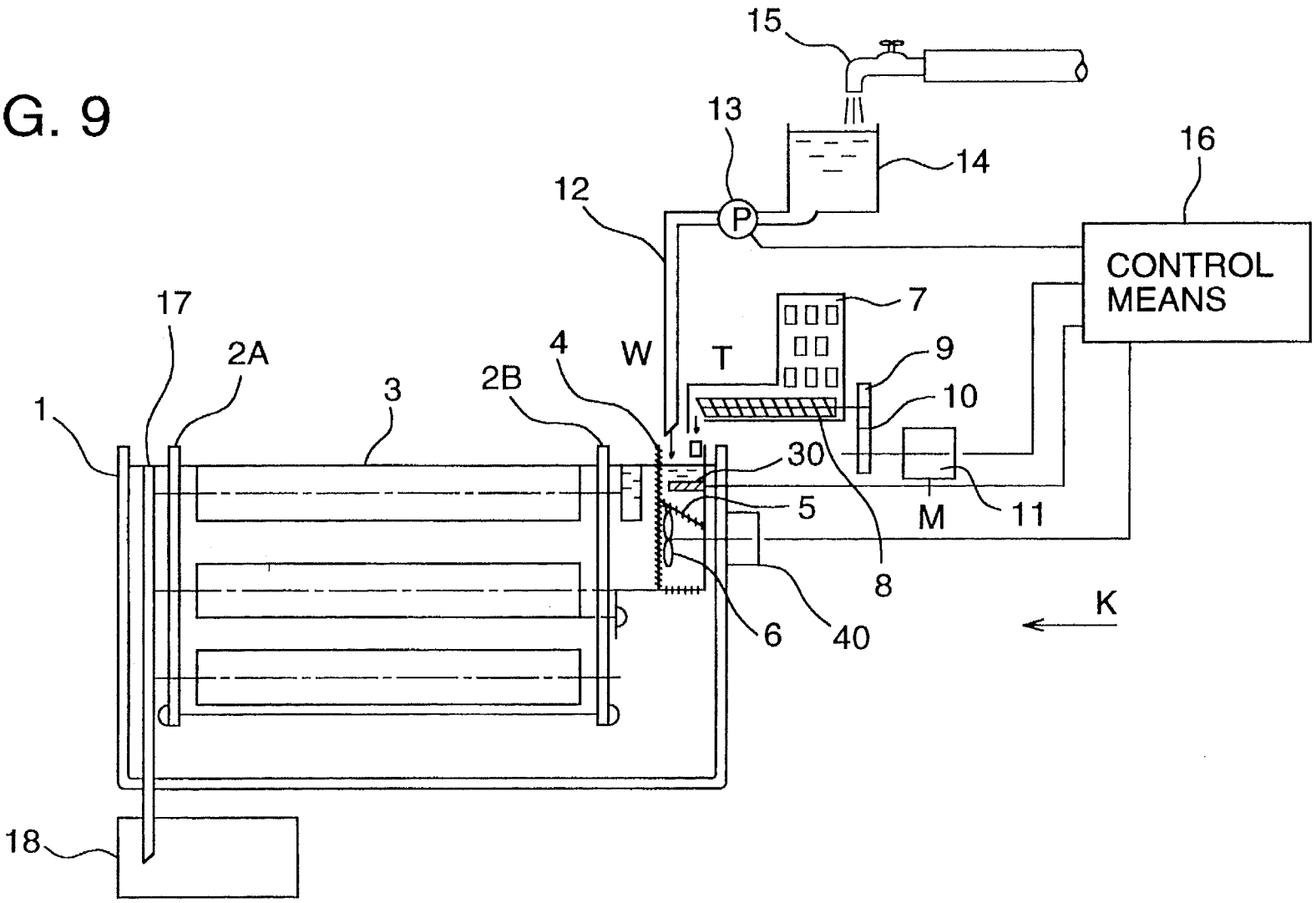
FIG. 9 is a sectional view of a photosensitive material processing apparatus of an example.
Figure 10:
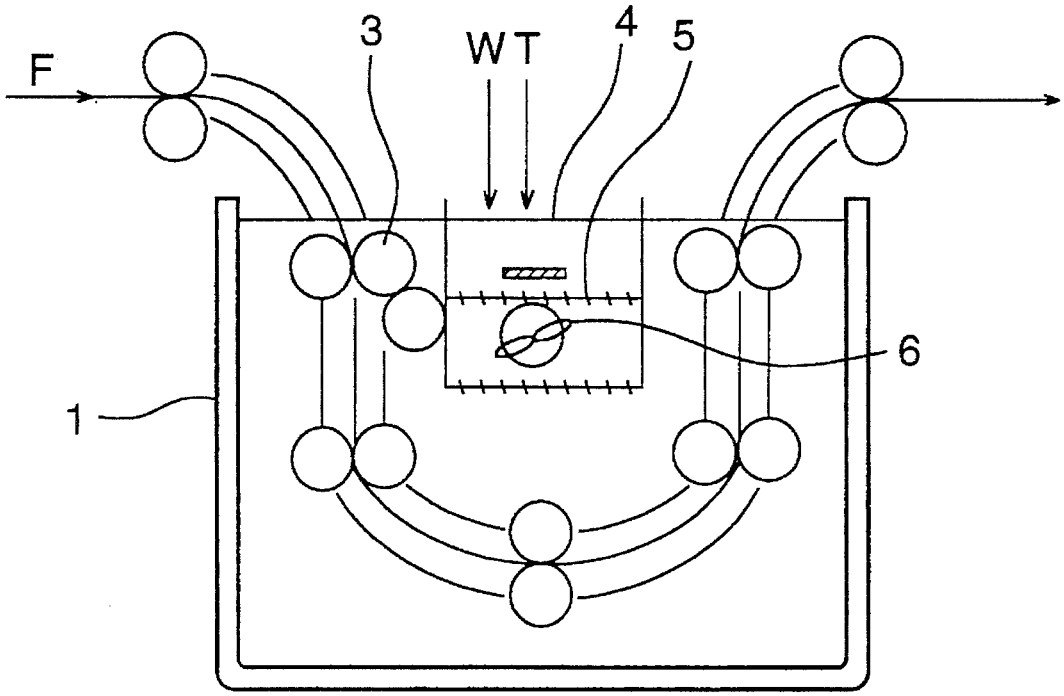
FIG. 10 is a sectional view of the photosensitive material processing apparatus taken from the direction of arrow K.

Next, with reference to FIGS. 9 and 10, an outline of the photosensitive material processing apparatus in which the present invention is applied to an example to accomplish the second object, will be explained as follows, wherein FIGS. 9 and 10 show an apparatus in which the apparatus shown in FIGS. 1 and 2 has been improved.

In FIG. 9, a sectional view of the processing tank 1 is shown, wherein the view is taken from the upstream side of the photosensitive material flow. The charging means 8 to charge a solid component T of the processing agent, and the pipe 12 to charge water W to be used as dissolving water are provided in the upper portion of a processing agent charging unit 4.

The processing agent charging unit 4 is provided in a space formed between a side wall of the processing tank 1 and a side plate 2B of a rack used for the conveyance of photographic material, so that the solid component can not directly enter a photosensitive material conveying passage. The rotary blade 6, which is a stirring means, and a temperature control device 30 are provided in a space separated by a partition member 5 such as a net or a plate having holes through which the processing solution can pass. By the action of the rotary blade 6, the dissolution of the solid component is facilitated, and further the dissolved processing solution is uniformly dispersed in the processing tank 1.

The rotary blade 6 is driven by a motor, the rotational speed of which can be controlled, and the motor is controlled by the control means 16.

FIG. 10 is a sectional view of the processing tank 1 including a processing agent charging unit 4 and the rotary blade 6, wherein the view is taken from the direction shown by arrow K in FIG. 9. Photosensitive material F is developed with a processing agent while it passes through a conveyance passage formed by the conveyance roller 3 as shown in FIG. 10.

The processing agent charged in the processing tank 1 is deteriorated when the photosensitive material F is processed in the tank 1, that is, components of the processing agent are consumed and the reaction products are accumulated in the processing agent, and further the processing agent is deteriorated with the age. For this reason, it is necessary to replenish the processing agent so as to continue the stable development operation.

The solid components T accommodated in the accommodation unit 7 are conveyed to an opening and charged into the tank 1 by the charging means 8. The time to charge the solid components is controlled by the control means 16.

City water 15 is stocked in the stock unit 14, and sent through the pipe 12 by the pump 13 connected with the control means 16. Then, water is poured to a portion close to the opening through which the solid component T is charged.

The temperature control device 30 is composed of a temperature sensor and a heater, or a heater and cooler, and controller by the control means 16.

The photosensitive material processing method and apparatus of the present invention are constructed in the manner described above. Therefore, the stock space for stocking the processing agent can be reduced, and the deterioration of the processing agent can be prevented while it is being stocked. Further, the dissolution speed is controlled to make up for the lowered processing capacity of the processing agent without costing much labor for dissolving and mixing. As a result, stability of processing can be ensured.

This invention especially, the solid component and water for making processing agent are supplied into a processing tank. Therefore it is not required to install a mixing device in particular, and neither requires particular agent solution circulation means. Finally, we strongly express that using this invention makes us quicker dissolution solid component and water than supplying solid component only in the agent solution.

What is claimed is:

1. A method of processing a photosensitive material in a processing solution so as to visualize a latent image formed in the photosensitive material, comprising:

feeding the solid component and water separately in a mother solution of the processing solution in a vessel; and controlling the dissolving speed of the solid component so as to stabilize the processing capability of the processing solution.

2. The method of claim 1, wherein the solid component and the water are arranged to be supplied into a processing tank which the photosensitive material is processed.

3. The method of claim 1, wherein the solid component and the water are arranged to be supplied into an accomodation unit beside of a processing unit. material, wherein the partition member is made to allow the processing solution to pass therethrough.

4. An apparatus for processing a photosensitive material in a processing solution so as to visualize a latent image formed in the photosensitive material, comprising:

a container;

a feeder to feed the solid components and water separately in the container;

a agitator capable of changing the dissolving speed of the solid component; and a controller to control the agitator so as to change the dissolving speed.

5. An apparatus for processing a photosensitive material in a processing solution so as to visualize a latent image formed in the photosensitive material, comprising:

a vessel in which a mother solution of the processing solution is stored;

a container communicated with the vessel;

a feeder to feed the solid components and water separately in the container;

a agitator capable of changing the dissolving speed of the solid component;

a sensor to detect the degree of the deterioration of the processing solution; and a controller to control the agitator so as to change the dissolving speed on the basis of the detection result of the sensor.

6. An apparatus for rendering visible a latent image formed in a photosensitive material by treatment of said material with a processing solution which contains a solid component and water, said apparatus comprising at least one processing tank for said material, a feeder for introduction of said solid component and said water into said processing tank, an agitator to stir said solid component and said water thereby to form said processing solution.

7. The apparatus of claim 6 further comprising a partition in said processing tank between said material and a zone into which said solid component and said water are fed, said partition permitting said processing solution formed by said solid component and said water to pass through and preventing undissolved solid component from passing therethrough.

8. An apparatus for rendering visible a latent image formed in a photosensitive material by treatment of said material with a processing solution which contains a solid component and water, said apparatus comprising at least one processing tank, an accommodation unit adjacent said tank, and a feeder for interduction of said solid component and said water into said unit.

9. An apparatus for rendering visible a latent image formed in a photosensitive material by treatment of said material with a processing solution which contains a solid component and water, said apparatus comprising at least one processing tank for said material, a feeder for introduction of said solid component and said water into said processing tank, an agitator to stir said solid component and said water thereby to form said processing solution, a transporter having a rotating member on said feeder, said member adapted to guide said solid component into said tank.

10. The apparatus of claim 9 wherein said rotating member has a spiral groove on its outer surface.

11. An apparatus for rendering visible a latent image formed in a photosensitive material by treatment of said material with a processing solution which contains a solid component and water, said apparatus comprising at least one processing tank, an accommodation unit adjacent said tank, and a feeder for introduction of said solid component and said water into said unit, a transporter having a rotating member on said feeder, said member adapted to guide said solid component into said unit.

12. The apparatus of claim 11 wherein said rotating member has a spiral groove on its outer surface.

13. A method of replenishing a fresh processing solution into a working processing solution being used to treat a photosensitive material so as to visualize a latent image formed in said photosensitive material, wherein the fresh processing solution is composed of a working amount of a solid component and a predetermined amount of water determined in accordance with said working amount of said solid component, said method comprising detecting a processed amount of said photosensitive material which has been treated or a time for which said working processing solution has been used to treat said photosensitive material;

feeding said working amount of a solid component and said predetermined amount of water separately into said working processing solution in accordance with said processed amount of said photosensitive material or the detected time; and dissolving said working amount of said solid component and said predetermined amount of water in said working solution whereby said fresh processing solution is formed in said working solution.

14. The method of claim 13, wherein the solid component is made in a form of a tablet.

15. The method of claim 13 wherein said predetermined amount of water is fed prior to feeding of said solid amount of said solid component.

16. The method of claim 13 wherein said working processing solution is stored in a tank in which said photosensitive material is treated.

17. The method of claim 16 wherein said solid component and said water are fed separately into said working processing solution in said tank.

18. The method of claim 16 wherein there is provided a processing agent charging section which communicates with said tank, and said solid component and said water are fed separately into said working processing solution in said processing agent charging section.

19. The method of claim 13 further comprising conveying said photosensitive material to said working processing solution and taking said photosensitive material away from said working processing solution, wherein said processed amount of said photosensitive material is detected during said conveying.

* * * * *